US006042179A

United States Patent [19]

Wallace, III

[11] Patent Number: 6,042,179

[45] Date of Patent: Mar. 28, 2000

[54] FOLDING TABLE AND BENCH ASSEMBLY

[75] Inventor: Millard F. Wallace, III, Wilmington, N.C.

[73] Assignee: Millworks, LLC, Medford, N.J.

[21] Appl. No.: 09/227,232

[22] Filed: Jan. 8, 1999

[51] Int. Cl.[7] ..... A47B 3/00

[52] U.S. Cl. ..... 297/158.4; 297/158.5; 108/132

[58] Field of Search ..... 297/158.4, 158.5, 297/159.1; 108/27, 90, 131, 132

[56] References Cited

U.S. PATENT DOCUMENTS

| | | | |
|---|---|---|---|
| 2,683,639 | 7/1954 | Brenny | 108/132 |
| 2,800,952 | 7/1957 | McPhilomy | 297/158.5 |
| 3,267,886 | 8/1966 | Glass | 108/132 X |
| 4,060,275 | 11/1977 | Hansen | 297/158.4 |
| 4,133,272 | 1/1979 | Naglowsky | 108/132 |
| 4,297,953 | 11/1981 | Shy | 108/132 X |
| 4,572,574 | 2/1986 | Fischhaber et al. | 297/158.4 |
| 5,240,307 | 8/1993 | Jones et al. | 297/159.1 |

FOREIGN PATENT DOCUMENTS

| | | | |
|---|---|---|---|
| 2194732 | 3/1988 | United Kingdom | 297/158.4 |

*Primary Examiner*—Peter R. Brown
*Attorney, Agent, or Firm*—Rhodes & Mason, PLLC

[57] ABSTRACT

A table and bench assembly moveable between a folded position and an unfolded position that includes a table top; a bench subassembly with first and second parallel benches supported on first and second parallel bracing members; two leg subassemblies mounted at one end of the table top and two leg subassemblies mounted at the other end of the table top. Each leg assembly includes a mounting member attached to the lower surface of the table top, a leg having an inner end rotatably attached to one end of the mounting member and freely rotatable between folded and open positions. Each leg assembly includes a locking member actuated when the leg reaches the open position to lock the leg in the open position.

19 Claims, 3 Drawing Sheets

FOLDING TABLE AND BENCH ASSEMBLY

BACKGROUND OF THE INVENTION (1) Field of the Invention

The present invention relates generally to a table and bench assembly, and in particular to a table and bench assembly that can be easily converted from a folded configuration to an unfolded configuration without the use of springs.

(2) Description of the Prior Art

Tables with attached benches on either side of the table, commonly known as picnic tables, are generally constructed with a rectangular table top that is supported on two pairs of legs. Each leg pair is attached to the undersurface of the table top adjacent one end of the table and is comprised of first and second legs that extend outwardly to opposite sides of the table. Horizontal bracing members are attached across each leg pair at approximately the mid-point of the legs, with the opposed ends of each bracing member extending beyond the table sides. Benches are then attached to the ends of the bracing members on each side of the table. The benches are generally positioned above the outer ends of the legs, so that the table will not tilt when individuals are seated on one of the benches.

The above table and bench assembly has been popular for many years, and has been used for many purposes in addition to outdoor picnics. Some styles are available as kitchen or dining furniture, and smaller versions can be used by children as play furniture. The overall assembly, however, is quite large and bulky, limiting its popularity for purposes that requires the table for only a limited period of time. Therefore, prior art assemblies have been devised that can be folded for storage while not in use and opened only when the table and bench assembly is needed.

For example, U.S. Pat. No. 5,411,314, issued May 2, 1995 to the present inventor, describes a table and bench assembly comprised of a rectangular table top, a bench assembly, and four leg assemblies. The table top includes a plurality of attached table braces, and at least two structural braces hingedly attached to at least two of the table braces so that the structural braces can be manipulated between a folded and unfolded position.

The bench assembly includes two bench brace members transversely positioned with respect to the table top, two seat members which are longitudinally positioned with respect to the table top and which are mounted at corresponding ends of the bench brace members and four bench stops, one each coupled to each intersection of the bench braces with the seat members, so that one end of each of the bench stops extends inward towards the table top beyond the inner edge of each seat member;

Each leg assembly is pivotally attached to the table top assembly and comprising a generally parallelogram-shaped leg body, having a rounded heel end for facilitating the pivoting of the leg assembly with respect to the table top, a spring slot cut in the heel end of the leg body to house a spring and spring rod, a spring rod inserted through the spring slot to enable attachment of one end of a spring thereto, a notch for engagement with one of the bench stops when the table is unfolded, and a spring, attached at one end to the spring rod and at the other end to the table top When the table is folded, all four leg assemblies are folded up underneath the table top assembly and the springs are under tension, the table top assembly rests on top of the bench braces with the structural braces in the folded position, so that an anchoring means can be inserted through the table braces, bench braces, and leg assemblies to anchor the table in the folded position. When the anchoring means is removed and the entire table structure is lifted by lifting up on the bench assembly, the leg assemblies are pulled by the springs to an unfolded position, and the bench assembly is then lowered into a position such that the bench stops engage the notches, placing the table in the unfolded position.

The above table and bench assembly has proven to be superior to other prior art structures since it can be stored in a limited space, and then easily unfolded for use. However, the use of springs to open and hold the legs creates a potential hazard, since the pull of the stretched springs on the 2×6 legs causes the legs to rotate rapidly and with considerable force. The spring assembly, in addition to adding to the cost of the table, can also break or become detached from the table creating a further hazard.

Also, the table legs are held in their extended position by the springs, which are under minimal tension when the table is in the unfolded position, allowing the legs to move inwardly when the table is being used. As a result, the table can be somewhat unstable, and the pinching action of the moving legs relative to the table top can create an additional hazard, especially when the table is constructed in smaller size versions for use as children's furniture.

Accordingly, there is a need for improvements in table and bench assemblies of the type described in the Wallace patent that would eliminate these hazards, while still providing an assembly that can be stored in a compact, folded configuration, and easily unfolded for use, especially when the table is designed for use by children.

SUMMARY OF THE INVENTION

The table and bench assembly of the present invention is generally comprised of a rectangular table top, a bench subassembly, and four leg subassemblies. The table top may be formed of a single piece of material, such as wood, or may be formed of multiple pieces joined together to form a top having parallel sides of a given length, parallel ends of a given width, a planar upper surface, and a bottom surface.

Alternatively, the top can include a peripheral frame around the sides and ends, and an insert that fits within the frame, so that the table can be used for different purposes. For example, when the assembly is to be used by children, the insert may be a plain wooden or plastic work surface, or a chalk or white board for use in drawing. Also, the surface can be printed with various designs, figures or games. Opposite sides of the insert can be used for different purposes by simply turning the insert over.

The bench subassembly is comprised of first and second, spaced, parallel bracing members, and first and second, spaced, parallel benches that are mounted adjacent the ends, and on top of, the bracing members. Each bracing member has a top surface, a bottom surface, and parallel sides of a given width. The vertical dimension of each bracing member is preferably greater than its width to optimize the strength of the member.

Each bench preferably has a length equal to the length of the table top, an inner edge, and an outer edge. When mounted on the bracing members, the inner edges of the benches are separated at a distance at least as great as, and preferably substantially equal to, the width of the table top, so that the benches can be positioned on either side of the table top when the table and bench assembly is in the folded position.

Each leg subassembly is comprised of a mounting member and a leg. Each mounting member has upper and lower surfaces, parallel sides, and ends that are preferably tapered inwardly from the upper surface of the member to the lower surface to eliminate any sharp corner that might cause injury. The length of each member is preferably substantially equal to, or slightly less than, the width of the table top.

Each leg has an upper end, a lower end, parallel upper and lower edges and parallel sides. The upper end of the leg in each subassembly is preferably rounded, and is pivotally or rotatably hinged adjacent one end of the corresponding mounting member, so that the leg is freely rotatable between a closed position parallel to the mounting member, and an open position when the table and bench assembly is unfolded. Preferably, a rotatable mounting block will be used to attach the leg and mounting member. However, other attachment means, such as a bolt extending though the two components, will be apparent to one skilled in the art. The mounting block may include bearings to reduce friction.

The mounting member includes a bracket or stop attached to the side of the mounting member on which the leg is mounted, and in the path of the leg to engage the edge of the leg when the leg is reaches its open position. Generally, the movement of the leg will be limited so that the leg extends outwardly at an angle of from about 10° to about 50°, and preferably from about 20° to 35° beyond vertical.

Also, the lengths of the legs are such that the lower ends of the legs extend beneath one of the benches when the assembly is unfolded, thereby preventing the assembly from tipping during use. Preferably, the inner side of the leg lower end is angled to fit onto the floor or other surface on which the assembly is positioned. The upper surface of each leg preferably has a bench support to engage a bench when the bench subassembly is lowered onto the legs during unfolding of the assembly. For example, the support may be in the form of a notch that engages the inner edge of the bench.

In order to hold each leg in secure relationship to its corresponding mounting member when the leg is in the extended position, each leg subassembly also includes a first locking member having a disengaged position and an engaged position to lock the leg in the extended position. For example, the first locking member may be comprised of a spring-loaded rod carried on the mounting member, with the rod being held in a retraced position by the end of the rod engaging the side of the leg when the leg is in the closed position. However, when the leg is rotated to the open position, an opening in the leg allows the rod to move into the hole under the action of the spring, locking the leg in position. Preferably, the rod has a handle or ball attached to its outer end, so that the rod can be withdrawn when the leg is to be returned to its retracted position.

Two leg subassemblies are mounted adjacent each end of the table top, with the subassemblies being oriented so that one leg will extend to one side of the table and the other leg will extend to the other side of the table. That is, a first or outer subassembly is mounted onto the lower surface of the table top with the mounting member parallel to one end of the table top, with the leg positioned to the interior of the mounting member.

A second or inner leg subassembly is mounted onto the lower surface of the table top as a given distance from the first leg subassembly, with the mounting member parallel to the mounting member of the first subassembly. This inner subassembly, which is of the same construction as the outer subassembly, is oriented with the leg on the outer side of the mounting member. Thus, when opened, the legs will extend to opposite sides of the table. An additional pair of leg subassemblies is also mounted in the same manner adjacent the other end of the table top.

The legs of the inner and outer leg subassemblies at each table top end are spaced at a distance at least equal to the given width of one of the bracing member of the bench subassembly, so that the bracing member can be inserted between the legs when the table and bench assembly is in the folded position. Also, the distance between the spaces separating each leg pair is equal to the distance between the bracing members of the bench subassembly, so that insertion of both bracing members can be made simultaneously to form a compact folded assembly.

A second locking member is also provided to hold the table and bench assembly in the folded position. A suitable second locking member, to be described in further detail in the description of the preferred embodiment, may be provided for each pair of leg subassemblies by drilling holes through the legs and mounting members of each pair of leg subassemblies and the bracing member to be inserted between the leg subassemblies, with the holes being aligned when the assembly is folded. A rod, preferably having a handle or ball at one end is then inserted through the aligned holes to prevent the assembly from opening.

The first locking member earlier described will normally be sufficient to hold the assembly securely in the opened position. However, additional stability may be provided by using a third locking member to secure each leg to one of the bracing members of the bench subassembly. Each third locking member may be formed by drilling a hole through each leg intermediate the leg's upper and lower ends, and a corresponding hole in the adjacent bracing member, so that the two holes are aligned when the assembly is in the unfolded position.

A rod is provided for each hole pair, and is inserted through the aligned holes to secure the assembly. These rods and holes may be threaded, if desired. Again, each rod preferably has a handle or ball mounted on one end to aid in insertion and removal. These rods may be stored by providing additional holes in the mounting member and leg of each pair, with these holes being aligned when the assembly is folded. The rods can then be simply inserted through these holes when the table is folded, providing convenient storage.

When in the folded position, the legs of each pair are in their closed position alongside their corresponding mounting member, and the bench subassembly assembly is positioned with the benches on either side of, and in a plane with, the table top. The bench subassembly bracing members are inserted between the legs of each pair of leg subassemblies. The first locking members are in their retracted positions, and the second locking members are inserted through the aligned holes of the leg subassembly pairs and the inserted bench bracing members. The third locking members, if used, are inserted through the other aligned holes in each leg subassembly.

In order to open the table and bench assembly, the assembly is placed on the floor or other surface in the upright position. The second locking members, and the third locking member if used, are removed. The assembly is rapidly lifted by grasping the benches. Since the legs are not secured in the closed position, and since the legs are freely rotatable around the pivot point, each leg swings down and out until the upper edge of the leg engages the bracket or stop extending from the corresponding mounting member into the path of the leg, i.e., until the leg reaches its open position. Engagement of each leg with the stop aligns a hole in the leg with the end of a retracted first locking member rod, permitting the rod under the force of the spring to project into the hole, thereby locking the leg in the extended position.

The bench subassembly is then lowered into engagement with the legs, with the inner edges of the benches engaging the receiving slots of the leg upper edges. If desired, the third locking members can then be inserted into the aligned holes in the legs and bench bracing members. The rods forming a part of the second locking members may be inserted back into the aligned holes in the mounting members of each leg subassembly pair for storage.

Therefore, instead of the deficiencies and potential hazards of the prior art table and bench assemblies that require tensioned springs to open and secure the legs in place, the present invention uses only the force of gravity to swing the legs from the closed to open position, and a locking member that extends into an opening in the side of the leg when the leg swings to its open position.

Accordingly, one aspect of the present invention is to provide a table and bench assembly moveable between a folded and unfolded positions comprising a table top; a bench assembly including first and second parallel benches, and first and second parallel bracing members, the benches being supported at the outer ends of the bracing members; a plurality of leg subassemblies, each of the leg assemblies including a mounting member attached to the lower surface of the table, a leg pivotally attached to the mounting member, the leg being freely pivotal between a folded position and open position, and a first locking member movable between a retracted position when the leg is in the closed position and a locking position when the leg is in the open position to holding the leg in the open position.

Another aspect of the present invention is to provide a folding table comprising a table top having first and second ends, and first and second sides, and a plurality of leg subassemblies, each of the leg subassemblies including: an elongated mounting member having an upper surface, first and second ends, and first and second sides; a leg rotatable between closed and open positions, the leg having inner and outer ends, first and second sides, and a rod receiving opening; a rotatable bearing block, the bearing block having a first plate attached to the first side of the mounting member adjacent the mounting member first end and a second plate attached to the first side of the leg adjacent the leg inner end; and a locking member mounted on the mounting member, the locking member including a rod having a withdrawn position and an extended position wherein the rod is inserted into the rod receiving opening when the leg is in the open position.

These and other aspects of the present invention will become apparent to those skilled in the art after a reading of the following description of the preferred embodiment.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation. Like elements are designated by like numbers. The drawings are for the purpose of illustrating the invention and are not intended to be to scale.

Figure 1:
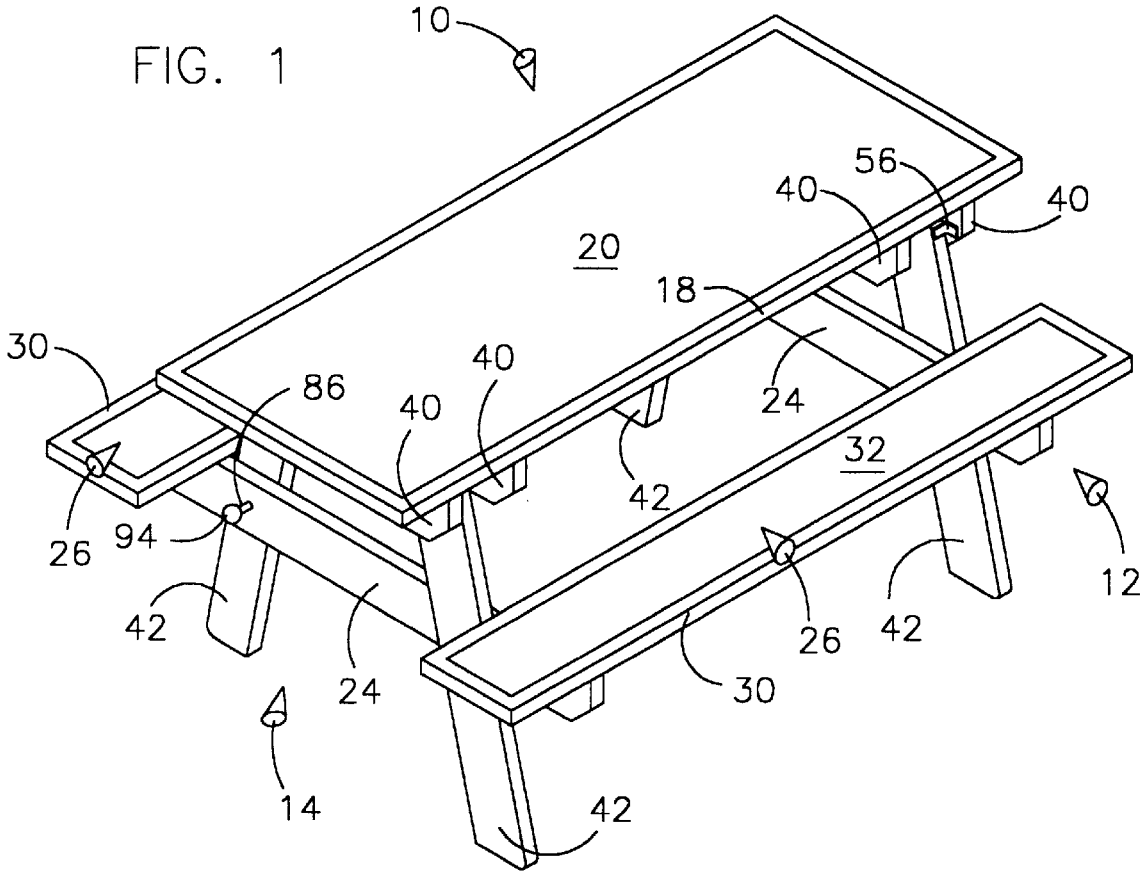
FIG. 1 is a perspective view of the table and bench assembly in the unfolded position.
Figure 2:
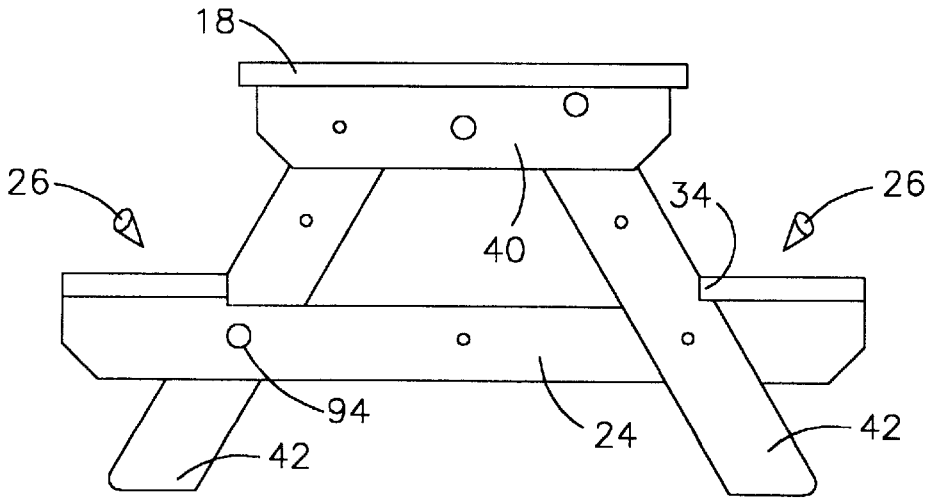
FIG. 2 is an end view of the table and bench assembly in the unfolded position.
Figure 3:
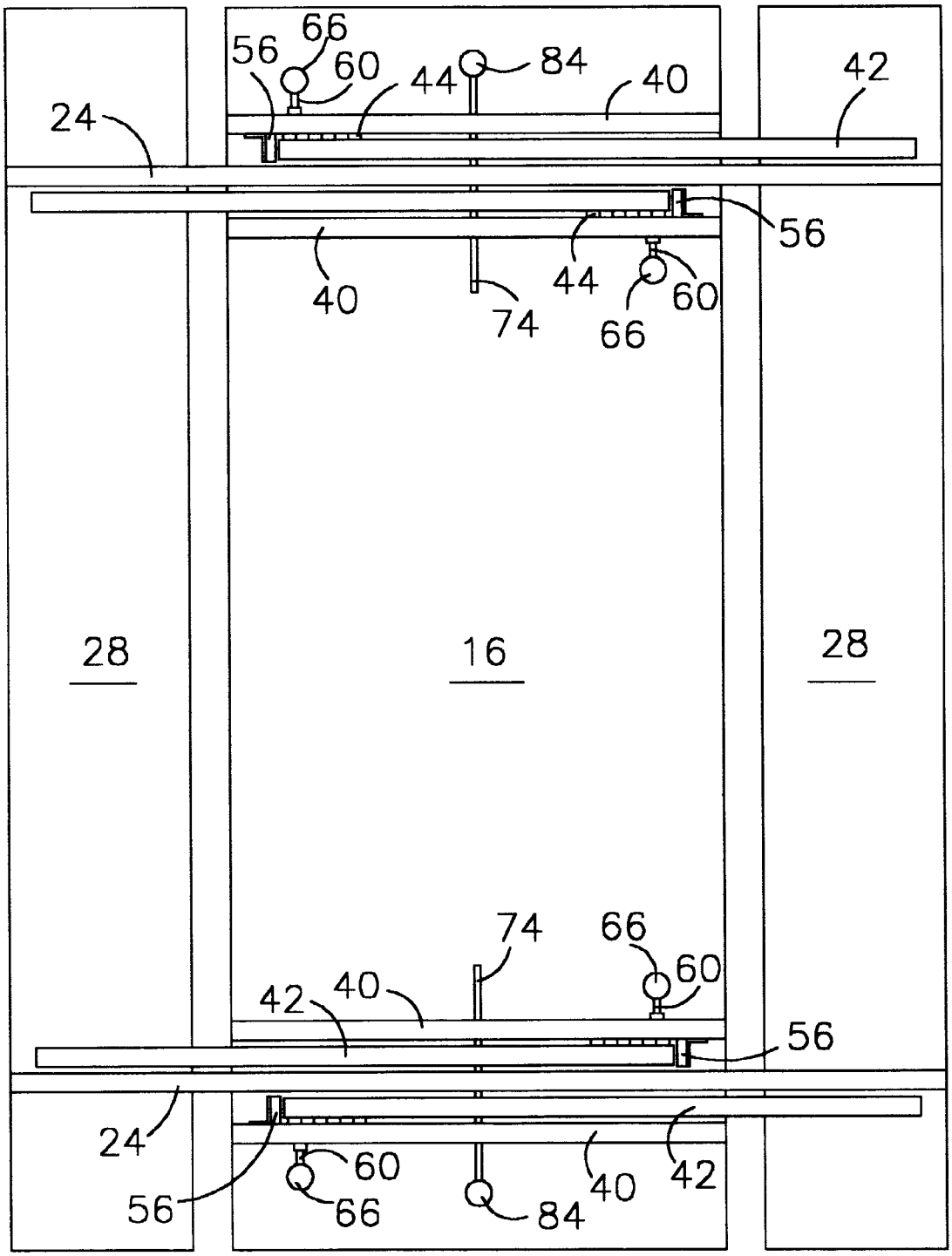
FIG. 3 is a bottom view of the table and bench assembly in the folded position.
Figure 4:
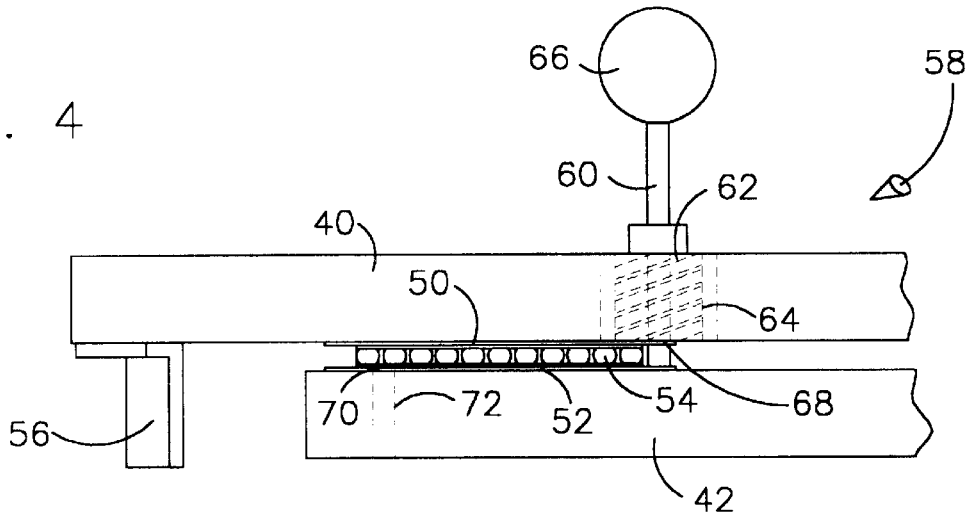
FIG. 4 is an enlarged top view of the connected end of a leg subassembly in the closed position.
Figure 5:
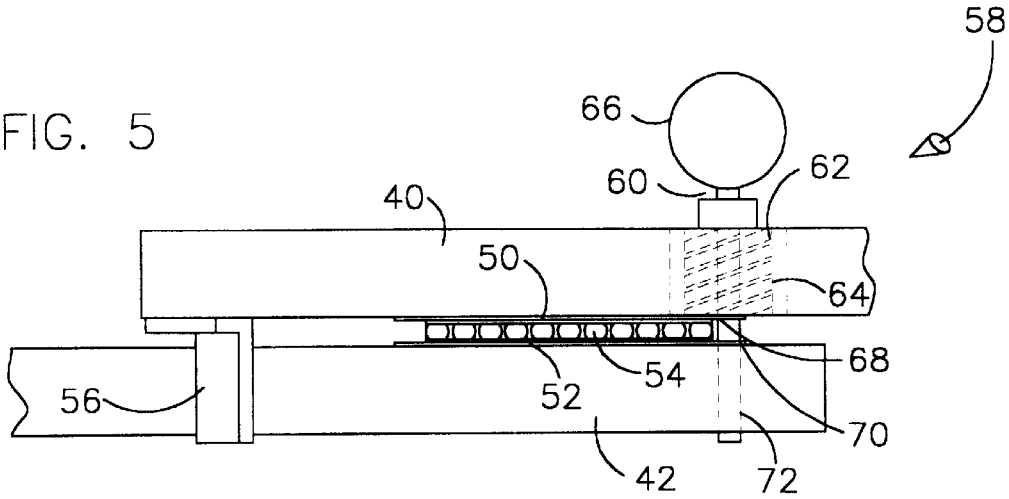
FIG. 5 is an enlarged top view of the connected end of a leg subassembly in the open position.
Figure 6:
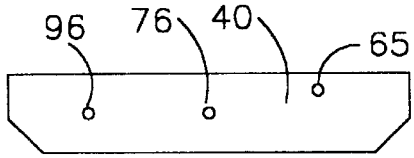
FIG. 6 is a side view of a mounting member.
Figure 7:
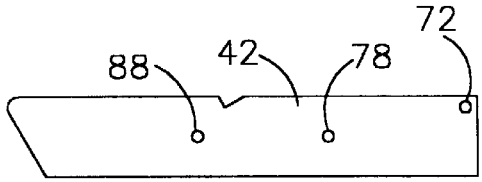
FIG. 7 is a side view of a leg.

As best seen in FIGS. 1–3, the table and bench assembly of the present invention is comprised of a table top, generally 10, a bench subassembly, generally 12, and four leg subassemblies, each generally 14. Top 10 is comprised of a rectangular base 16, a rectangular frame 18 around and projecting upwardly from base 16, and a removable insert or top plate 20. Plate 20 may also be removably attached to base 16 without using frame 18.

Figure 8:
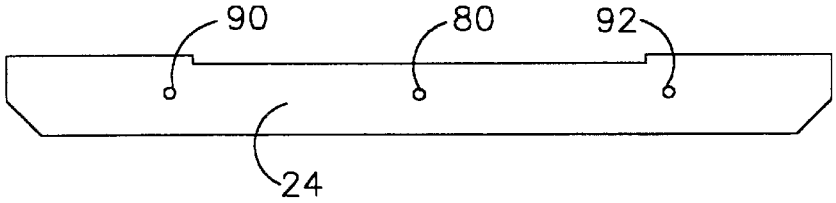
FIG. 8 is a side view of a bracing member.

Bench subassembly 12 is comprised of a spaced, parallel bracing members 24 (illustrated in FIG. 8) and benches 26 supported at the ends of members 24. Benches 26 include bottom plates 28, peripheral frames 30, and removable inserts 32, respectively. Alternatively, benches 26 may be constructed without inserts. The outer ends of members 24 are tapered upwardly for appearance and safety. The distance between benches 26 is slightly greater than the width of table. A rectangular recess 34 is located at the top of bracing member 24 to receive top 10, thereby preventing top 10 from shifting laterally when the assembly is in the folded configuration.

Each leg subassembly 14 is comprised of a mounting member 40 and a leg 42, pivotally attached at its upper end to one side of mounting member 40 with a rotatable bearing block, generally 44. Block 44 is comprised of mounting plates 50 and 52, rotatable of either side of bearing 54. A stop 56 is attached to the side of mounting member 40 in the pathway of rotatable leg 42 to stop leg 42 at the desired open position.

Each leg subassembly 14 includes a first locking member, generally 58, comprised of a rod 60, a compression spring 62 within a housing 64, and a handle 66 at the end of rod 60. Locking member 58 is mounted in an opening 65 that extends transversely through mounting member 40 adjacent one end of member 40. Retraction of rod 60 by pulling on handle 66 compresses spring 62. Rod 60 is aligned with an opening 68 in plate 50 at all times and with an opening 70 in plate 52 and opening 72 in leg 42, when leg 42 is rotated into engagement with stop 56.

Thus, rod 60 is held in the retracted position when the leg is not in the fully extended position by engagement of the end of rod 60 with plate 52. However, when leg 42 is in the fully extended position, rod 60 is urged by spring 62 through openings 70 and 72, locking leg 42 in the extended position.

When the table and bench assembly is in the folded position, as shown in FIG. 3, legs 42 are held in the closed position, and bench subassembly 12 is held in engagement with top 10 by rods 74 that extend through aligned openings 76 and 78 in mounting members 40 and legs 42, respectively, and openings 80 in bracing members 24. A handle 84 is attached to the outer end of each rod 74 to facilitate insertion and removal. When legs 42 are in their extended position, rods 74 can be reinserted into openings 76 for storage.

The table and bench assembly illustrated also includes a third locking member comprised of a rod 86 that extends through opening 88 in leg 42 and openings 90 or 92 in bracing member 24 when the assembly is in the unfolded position. Each rod 86 also includes a handle 94 at one end.

When the assembly is folded for storage as illustrated in FIG. 3, leg 42 of each subassembly 14 is rotated alongside corresponding mounting member 40, which is attached to the underside of top 10. Benches 26 of bench subassembly 12 are positioned on either side of, and in a plane with, table top 10, while members 24 are inserted between each pair of leg subassemblies 14.

Rods 60 of first locking members 58 are held in the retracted position by engagement of the distal end of rod 60 with plate 52. Leg subassemblies 14 in held in the closed position, and bench subassembly 12 is held against top 10 with rods 74 inserted through the openings in members 40, legs 42, and bracing members 24. Rods 86 may be inserted through holes 88 in leg 42 and aligned hole 96 in member 40.

The table and bench assembly is opened by removing rods 74 and 86, grasping the ends of benches 26, and quickly lifting the entire assembly. When the assembly is lifted, legs 42 rotate down and out about bearing blocks 44 until engaging stops 56. As legs 42 engage stops 56, rods 60 are urged by compression springs 62 through openings 70 in plates 52 and openings 72 in legs 42 to lock legs 42 in the extended position.

Thus, the assembly of the present invention can be stored as a compact unit, but readily opened to form a structurally rigid assembly of a table and adjacent benches, without using exposed springs that can create a hazard.

Certain modifications and improvements will occur to those skilled in the art upon a reading of the foregoing description. It should be understood that all such modifications and improvements have been deleted herein for the sake of conciseness and readability but are properly within the scope of the follow claims.

What is claimed is:

1. A table and bench assembly moveable between a folded position and an unfolded position comprising:

a) a table top having first and second ends, first and second sides, and a lower surface;

b) a bench assembly including first and second parallel benches, and first and second parallel bracing members, said benches being supported at the outer ends of said bracing members, said first bench being adjacent said top first side and said second bench being adjacent said top second side, and said benches being in a plane with said top when said assembly is in the folded position;

c) a plurality of leg subassemblies, each of said leg assemblies including a mounting member attached to the lower surface of said table, a leg having an upper end pivotally attached at a pivot point to said mounting member, said leg being freely rotatable at said pivot point between a closed position parallel to said mounting member and open position projecting outwardly beyond one side of said top, and a first locking member movable between a disengaged position when said leg is in the closed position and an engaged position when said leg is in the open position to secure said leg in the open position to said mounting member, said bench assembly resting on the legs of said leg subassemblies when said table is in the unfolded position.

2. The assembly of claim 1, including first and second leg subassemblies transversely mounted to the lower surface of said table top adjacent said first end, and third and fourth leg subassemblies transversely mounted to the lower surface of said table top adjacent said second end, the legs of said first and third subassemblies projecting beyond said table top first side when in the open position, and the legs of said second and fourth subassemblies projecting beyond said table top second side when in the open position.

3. The assembly of claim 1, wherein said table top includes a rectangular base, a peripheral frame projecting above said base, and a removable insert within said frame.

4. The assembly of claim 1, wherein said first locking member is comprised of a rod moveable between a retracted position and an extended position, said leg including an opening to receive said rod in said extended position when said leg is in the open position.

5. The assembly of claim 1, wherein said legs have lower ends positioned beneath said benches when said assembly is in the unfolded position.

6. The assembly of claim 1, further including second locking members connecting the bracing members of said bench assembly to the mounting members and legs of said leg subassemblies when said assembly is in the folded position.

7. A table and bench assembly moveable between a folded position and an unfolded position comprising:

a) a table top having first and second ends, first and second sides, and a lower surface;

b) a bench assembly including first and second parallel benches, and first and second parallel bracing members, said benches being supported at the outer ends of said bracing members, said first bench being adjacent said top first side and said second bench being adjacent said top second side, and said benches being in a plane with said top when said assembly is in the folded position;

c) a first pair of leg subassemblies transversely mounted to the lower surface of said table top adjacent said first end, and a second pair of leg subassemblies transversely mounted to the lower surface of said table top adjacent said second end, each leg assembly including a mounting member attached to the lower surface of said table, a leg having an upper end pivotally attached at a pivot point to said mounting member, said leg being freely rotatable at said pivot point between a closed position parallel to said mounting member and open position, and a first locking member movable between a retracted position when said leg is in the closed position and an extended position when said leg is in the open position securing said leg to said mounting member, one leg of each pair of leg subassemblies projecting beyond said table top first side when in the open position, and the other legs of each leg subassembly projecting beyond said table top second side when in the open position, said bench assembly resting on the legs of said leg subassemblies when said table is in the unfolded position.

8. The assembly of claim 7, wherein said first locking member is comprised of a rod, and a spring attached to said rod, said spring being in a compressed state when said locking member is in the retracted position, said leg including an opening to receive said rod, said spring urging said rod into said opening when said opening is aligned with said rod.

9. The assembly of claim 7, wherein said table top includes a removable insert on its upper surface.

10. The assembly of claim 7, wherein said bench subassembly rests on the legs of said leg subassemblies when said assembly is in the unfolded position.

11. The assembly of claim 7, wherein the leg of each leg subassembly is rotatable along a pathway between the closed and extended position, and the mounting member of each of said leg subassembly includes a stop projecting from said mounting member into said pathway, said stop being engaged by the leg of said subassembly when said leg is rotated to the open position.

12. The assembly of claim 7, further including second locking members connecting said first bracing member to the mounting members and legs of said first and second leg subassemblies, and said second bracing member to the mounting members and legs of said third and fourth leg subassemblies when said assembly is in the folded position.

13. The assembly of claim 12, further including third locking members locking the leg and mounting member of each leg subassembly together when said assembly is in the open position.

14. A folding table comprising a table top having first and second ends, first and second sides, and a lower surface, and a plurality of leg subassemblies, each of said leg subassemblies including:

a) an elongated mounting member parallel to one of said ends, said mounting member having an upper surface attached to the lower surface of said top, first and second ends, and first and second sides;

b) a leg rotatable between closed and open positions, said leg having inner and outer ends, first and second sides, and a rod receiving opening;

c) a rotatable mounting block, said mounting block having a first plate attached to the first side of said mounting member adjacent the mounting member first end and a second plate attached to the first side of said leg adjacent said leg inner end; and d) a locking member mounted on said mounting member, said locking member including a rod having a withdrawn position and an extended position wherein said rod is inserted into said rod receiving opening when said leg is in the open position.

15. The assembly of claim 14, including outer and inner leg subassemblies mounted transversely beneath said table top adjacent said first end, and outer and inner subassemblies mounted transversely beneath said table top adjacent said second end, the legs of said outer subassemblies opening outwardly toward the one side of said table top, and the legs of the inner subassemblies opening outwardly toward the other side of said table top.

16. The assembly of claim 14, further including a bench subassembly having first and second parallel benches, and first and second parallel bracing members with first and second ends, said first bench being supported on said bracing member first ends, and said second bench being supported on said bracing member second ends, said benches being adjacent the sides of said table top when said assembly is in a folded position, said bench subassembly being supported by the legs of said leg subassemblies when said assembly is in an unfolded position.

17. The assembly of claim 14, wherein said rod includes a distal end engaging said second plate to hold said rod in a retracted position until said leg is in the open position, said second plate including an opening aligned with the opening in said leg.

18. The assembly of claim 14, further including a stop mounted in the path of rotation of said leg, said leg engaging said stop when said leg reaches the open position.

19. A table and bench assembly moveable between a folded position and an unfolded position comprising:

a) a table top having first and second ends, first and second sides, and a lower surface;

b) a bench assembly including first and second parallel benches, and first and second parallel bracing members, said benches being supported at the outer ends of said bracing members, said first bench being adjacent said top first side and said second bench being adjacent said top second side, and said benches being in a plane with said top, when said assembly is in the folded position; and c) a first pair of leg subassemblies transversely mounted to the lower surface of said table top adjacent said first end, and a second pair of leg subassemblies transversely mounted to the lower surface of said table top adjacent said second end, each leg assembly including a mounting member attached to the lower surface of said table, a leg having an upper end pivotally attached at a pivot point to said mounting member, said leg being freely rotatable at said pivot point between a closed position parallel to said mounting member and open position, and a first locking member movable between a retracted position when said leg is in the closed position and an extended position when said leg is in the open position securing said leg to said mounting member, one leg of each pair of leg subassemblies projecting beyond said table top first side when in the open position, and the other legs of each leg subassembly projecting beyond said table top second side when in the open position, said bench assembly resting on the legs of said leg subassemblies when said table is in the unfolded position, each of said leg subassemblies further include a rotatable mounting block with a first plate attached adjacent one end of said mounting member, and a second plate attached adjacent the upper end of said leg, said first plate being freely rotatable in relation to said second plate.

* * * * *